US010023369B2

(12) United States Patent
Ruhnau

(10) Patent No.: US 10,023,369 B2
(45) Date of Patent: Jul. 17, 2018

(54) ATTACHMENT FOR A LIQUID CONTAINER

(71) Applicant: Harald Ruhnau, Hamm (DE)

(72) Inventor: Harald Ruhnau, Hamm (DE)

( * ) Notice: Subject to any disclaimer, the term of this patent is extended or adjusted under 35 U.S.C. 154(b) by 0 days.

(21) Appl. No.: 14/442,192

(22) PCT Filed: Oct. 18, 2013

(86) PCT No.: PCT/EP2013/071831
§ 371 (c)(1),
(2) Date: Mar. 17, 2016

(87) PCT Pub. No.: WO2014/072160
PCT Pub. Date: May 15, 2014

(65) Prior Publication Data

US 2016/0207675 A1 Jul. 21, 2016

(30) Foreign Application Priority Data

Nov. 12, 2012 (DE) ..... 10 2012 110 833

(51) Int. Cl.
*B65D 51/28* (2006.01)

(52) U.S. Cl.
CPC ..... *B65D 51/2807* (2013.01)

(58) Field of Classification Search
CPC ..... B65D 51/007; B65D 51/2807; B65D 81/3211
USPC ..... 222/570; 220/713, 711, 243, 248, 251, 220/787, 789
See application file for complete search history.

(56) References Cited

U.S. PATENT DOCUMENTS 2,456,989 A * 12/1948 Polcyn ..... A47G 19/2272 220/713
3,858,747 A * 1/1975 Wharton ..... B65D 51/007 220/243
4,852,776 A * 8/1989 Patton ..... B65D 25/48 222/570

(Continued)

FOREIGN PATENT DOCUMENTS

DE 20 2005 001 115 6/2005
DE 20 2008 008 018 9/2008
FR 3027593 B1 * 6/2017 ..... B65D 17/506

(Continued)

OTHER PUBLICATIONS

International Apln No. PCT/EP2013/071831 search report dated Jan. 23, 2014.

*Primary Examiner* — J. Gregory Pickett
*Assistant Examiner* — Allan Stevens
(74) *Attorney, Agent, or Firm* — Bachman & LaPointe, PC

(57) ABSTRACT

An attachment (1) for a liquid container with a container outlet, wherein the liquid container is surrounded by a container wall and is intended to receive a first liquid, wherein the attachment (1) has a bearing surface (2), which defines a bearing plane (A), for bearing in a sealing manner against the liquid container a reservoir (4) for a second liquid, a channel (6), which connects the container outlet to an outlet (10) of the attachment (1) and a passage (44), which connects the reservoir (4) to the channel (6), wherein the attachment (1) is equipped with a clamping lever (14), which extends in a use position through the bearing plane (A) and the container outlet and which has a pressing surface (32) facing the inner side of the liquid container in the use position.

9 Claims, 3 Drawing Sheets

(56) References Cited

U.S. PATENT DOCUMENTS 6,155,452 A * 12/2000 Laurent ..... B65D 81/3876
220/711

FOREIGN PATENT DOCUMENTS

GB 2 259 241 3/1993
WO WO 2011003048 A1 * 1/2011 ..... B65D 81/3211

* cited by examiner

ATTACHMENT FOR A LIQUID CONTAINER

BACKGROUND OF THE INVENTION

The invention relates to an attachment for a liquid container.

Within the scope of the invention, in particular beverage cans are referred to as liquid containers without excluding other vessels or bottles. In particular for producing mixed drinks, attachments are known that are placed on beverage cans. The beverage cans have an edge protruding over the side wall, which surrounds the cover. Known attachments are fastened on this beverage can by clamping on the edge of an opened beverage can, as disclosed in DE 20 2008 008 018 U1. The liquid container has an outlet, which is normally arranged in the cover. The outlet is usually closed after filling; the closure is preferably fastened undetachably on the container, e.g. as a riveted tab. DE 20 2005 001 115 U1 shows an alternative solution for an attachment, which is to be applied to liquid containers.

The attachment must be fixed in a liquid-tight manner on the container and the liquid-tight connection must withstand the emptying of the container and, if applicable, the drinking from the liquid container without leaking. The production of this type of liquid-tight connection is problematic.

SUMMARY OF THE INVENTION

The object of the invention is to suggest an attachment for a liquid container, which establishes a liquid-tight connection in all use positions.

The invention relates to an attachment with the characteristics disclosed herein.

The attachment according to the invention is intended for a liquid container for a first liquid with a container outlet, which is surrounded by a container wall. The attachment has

- a bearing surface, which defines a bearing plane, for bearing in a sealing manner against the liquid container
- a reservoir for a second liquid,
- a channel, which connects the container outlet to an outlet of the attachment and
- a passage, which connects the reservoir to the channel. According to the invention, this attachment is characterized in that the attachment is equipped with a clamping lever, which extends through the bearing plane and the container outlet in the use position and which is intended to bear against an inner side of the liquid container.

The attachment is intended for liquid containers. Without excluding other liquid containers, the attachment according to the invention is explained in greater detail below based on the example of a beverage can. Like other liquid containers, beverage cans have a container wall, respectively shaped as a floor, a cylindrical side wall extending upwards from the floor and a cover, which is provided with a container outlet for the first liquid contained in the beverage can. The outlet is defined by the container wall, which is arranged in a plane with the container outlet. The first liquid contained therein can be removed from the liquid container through the outlet, for example through pouring out or drinking. The removal of the first liquid from the liquid container through the container outlet is the proper use of the liquid container or respectively of the beverage can. The container outlet is generally closed after filling. The closure is preferably undetachably applied to the liquid container, e.g. as riveted tab with opening lever.

The attachment according to the invention has a bearing surface. The bearing surface bears in the use position, i.e. when the attachment is mounted on the liquid container, against the container wall. Moreover, the bearing surface surrounds the outlet of the container in a sealing manner. The bearing surface can have any shape. It is preferably designed as a narrow, circumferential surface. It can preferably be described as an edge of the attachment. The dimensions of the bearing surface can emulate the contour of the outlet or it can be measured such that it holds a wider separation distance from the outlet and thus fits for outlets with a different shape or size.

The bearing surface is intended to bear against the container wall and to act in a sealing manner. It thus defines a bearing plane. The bearing surface is not designed to be connected with the liquid container via forces which act on the container wall parallel to the plane of the outlet. In particular, the bearing surface is not designed to be connected with the container wall by clamps or pawls. The plane of the outlet and the bearing plane progress approximately parallel to each other in the use position.

According to a further preferred embodiment, the bearing surface is provided with a sealing material. The sealing material is preferably elastic and compensates for unevennesses in the container wall without the sealing effect of the bearing surface being lost. Elastic materials are preferably used as the sealing material. This includes in particular rubber, latex and synthetic elastic materials.

The attachment has a reservoir, which is intended to accommodate a second liquid. The reservoir is surrounded by the material of the attachment and is thus delimited from the surroundings. The reservoir can have any shape. The reservoir can have any volume; however, the volume of the reservoir is preferably lower than the volume of the liquid container onto which the attachment is fitted. The ratio of the volume of the reservoir of the attachment to the volume of the liquid container is preferably 1:5 to 1:100, advantageously 1:10 to 1:50.

The attachment has a channel, which establishes a connection between the container outlet of the liquid container and an outlet of the attachment. The channel thus establishes a line or respectively a flow connection through the attachment. The channel is arranged within the bearing surface. The inlet opening of the channel facing the container outlet does not need to bear against the container outlet directly. Normally, a space is created between the container outlet and the inlet opening of the channel. The first liquid flows mainly loss-free from the container into the channel of the attachment through the space which is formed between the container, the bearing surface and the inlet opening of the channel.

The channel has an outlet on the end lying opposite the inlet opening. The outlet is preferably formed ergonomically, for example as drain or a drink opening. The channel can have any cross-section, e.g. in order to better meet requirements for designing the attachment. Inlet opening and outlet can have different cross-sections, also in order to ensure the quickest possible emptying of the liquid container or in order to ensure the most compact possible structural shape of the attachment. The channel connects inlet opening and outlet and can have for this purpose an adjustable cross-section, tapering or expanding cross-section, e.g. in order to optimize flow conditions when removing the first liquid or the first and the second liquid.

The channel and reservoir of the attachment are mainly separated from each other. Only one passage is provided between the reservoir and the channel, through which the second liquid passes from the reservoir into the channel. The passage is arranged between the inlet opening and the outlet of the channel preferably closer to the outlet. In the case of the horizontal alignment of the attachment, in which the outlet is arranged above the inlet opening of the channel, the passage is preferably arranged above the level of the second liquid in the reservoir. The passage is preferably closable in order to prevent an uncontrolled leakage of the second liquid. The closure of the passage is advantageously established as an adhesive film made of plastic, metal, liquid-tight paper or a composite material.

The passage is preferably measured such that, during emptying, the liquid container and reservoir empty simultaneously in the equal parts so that a constant mix ratio of the first and second liquid is achieved. The passage of the attachment to the container outlet is advantageously in a proportion of 1:10 to 1:200, particularly advantageously 1:20 to 1:100.

An important characteristic of the invention is that the attachment is equipped with a clamping lever, which extends in the use position through the bearing plane and the container outlet and has a pressing surface facing the inner side of the liquid container in the use position. The clamping lever can be formed as a lever, tongue or bracket or in another manner.

In contrast to known attachments for liquid containers, the attachment is not fixed through fastening on the edge of the cover, in which the container outlet is arranged. According to the invention, the clamping lever, which penetrates the bearing plane and the container outlet and which bears against the inner side of the liquid container with the pressing surface, effectuates the fixing of the attachment on the liquid container. In a preferred embodiment, the clamping lever bears with its pressing surface against the inner side of the cover.

The sealing between the attachment and the liquid container is achieved through the fixing of the container wall, which surrounds the container outlet, via the clamping lever, which defines the container wall between the clamping lever and the bearing surface. At least one component from the group, which comprises the container wall, the clamping lever and the bearing surface, is thereby designed elastically. Two or even three components of the aforementioned group are preferably designed elastically. Through the combination of elastic and rigid components or elastic components alone, it is possible to fasten the attachment on the liquid container by means of the clamping lever advantageously through tensioning, locking or clamping without using the edge of the container to establish the connection.

The prerequisite for this is that the pressing surface, which preferably acts within the bearing surface on the inner side of the container wall (usually on the inside of the cover), is arranged at a suitable separation distance from the bearing surface. Correspondingly, the clamping lever is dimensioned according to the separation distance from the bearing surface and if applicable tilt of the pressing surface such that the clamping lever is inserted through the container outlet upon placement on the liquid container and is pushed under the container wall adjacent to the container outlet until the bearing surface rests on the outside of the container wall. A force is thereby established, which according to a preferred embodiment leads to the deformation of the seal, which is applied to the bearing surface. The seal and thus the attachment now rest against the liquid container in a sealing manner. In relation to the radius of the bearing surface, the pressing surface is arranged in the center of the bearing surface or in an area of up to ⅔ of the radius around the center of the bearing surface, preferably of up to ⅓ of the radius around the center.

According to an alternative embodiment, the container wall or parts of the container wall, e.g. the undetachable tab of a closure for a container outlet, may be designed elastically. The container wall, typically the cover of a container, or the parts of the container wall can then, after the insertion of the clamping lever, exert a force against the attachment or the clamping lever, which alone ensures a sealing placement of the bearing surface on the container wall or which additionally contributes to the effective placement of the bearing surface or respectively the seal. Alternatively or in addition to the deformation of the seal, the cover or the tab of the closure of the liquid container is thus deformed by the clamping lever that they rest in a sealing manner on the bearing surface or seal of the attachment.

According to a further alternative, the clamping lever can be designed elastically. This is advantageous when the container wall is rigid all around the container outlet and a clamping lever designed elastically, e.g. like a spring, establishes a force, which contributes to the sealed placement of the bearing surface or the seal on the container wall.

Since the attachment should advantageously fit for containers with different dimensions, an arrangement for fastening is particularly suitable, which comprises a clamping lever and a bearing surface and which ensures a fixing of the attachment on the liquid container by means of forces, which act perpendicularly to the bearing plane defined by the bearing surface. The definition of the container wall between the clamping lever and the bearing surface effectuates a simpler sealing of the attachment on the liquid container than a fastening, which is established through a tensioning on the edge of the container cover. The attachment according to the invention can be used in this manner without structural changes e.g. for cans with a small or large cross-section, which have correspondingly covers with a small or large diameter.

The attachment according to the invention simultaneously reduces the space between the reservoir and the cover of the liquid container, because the bearing surface of the attachment according to the invention has a smaller diameter than known attachments, which extend beyond the edge of the container. An easier and more complete emptying of the container is thereby better ensured. Additionally, material is saved, because the attachment according to the invention can be produced with smaller dimensions overall.

The clamping lever is fastened to the attachment. It is generally designed elongated and angled and extends from the attachment in the direction towards or through the bearing plane. A first section of the clamping lever extends, in relation to the bearing plane, at a steep tilt from the attachment in the direction of the bearing plane, a second section, which connects to the first section, progresses at a shallow tilt towards the bearing plane. The slope of the first section is, in relation to the bearing plane, approx. 60° to 90°, wherein 90°, i.e. the maximum slope, is preferred. The slope of the second section is 15° to 60°, preferably 25° to 45° in relation to the bearing plane. The specified tilt refers to the central axis of the first or respectively second section of the clamping lever, since the top side and bottom side of the clamping lever can have different tilts. The second section ends free, preferably in the center of the bearing plane or respectively in a half radius all around the center of the bearing plane. The first and the second sections can merge in discrete steps or continuously. The second section carries the pressing surface. It is usually attached to the side of the clamping lever facing the attachment.

The clamping lever can be inserted through the second section arranged at a shallow tilt during placement of the attachment through the container outlet simply under the container wall and the required separation distance between the clamping lever or respectively the pressing surface and bearing surface can be set in a simple manner.

A particularly advantageous design of the invention provides that the top side and the bottom side of the clamping lever do not progress in a parallel manner. The shaping of the top side and the bottom side considerably influence the simple and secure mounting of the attachment on the container. The elasticity and stability of the clamping lever is simultaneously determined by the setting of the strength of the clamping lever, i.e. by the separation distance between the top side and the bottom side.

Furthermore, a design of the clamping lever in which the second section has on its top side surfaces with a different slope is advantageous. It is preferred if a guide surface which has a steeper slope than a directly adjacent pressing surface, which extends from the first section in the direction of the free end of the clamping lever, extends on the second section of the free end of the clamping lever in the direction of the first section.

The guide surface, which has a slope of 20° to 70°, is designed steep, in order to ensure a simple insertion of the clamping lever through the outlet to the container wall. The connecting pressing surface is designed with a shallower tilt, in order to achieve a secure fixing of the attachment for different containers with e.g. differently shaped covers or with different wall thicknesses. The pressing surface can be designed parallel or with a different tilt than the bottom side of the clamping lever. The pressing surface can also be designed in a rounded manner. The variable design of the pressing surface, i.e. parallel to the bearing plane, titled or rounded, enables the optimal locking of the attachment on the liquid container.

The clamping lever is advantageously designed as a lever, a tab or a spring. The clamping lever can be designed as a solid body or a hollow body. It can be made of plastic, metal or other substances, which have the required stability or elasticity properties. The dimensions of the clamping lever are on the one hand limited by the dimensions of the container outlet, through which the clamping lever is to be inserted upon mounting on the container. They are on the other hand specified by the requirements for stability and elasticity. Within the scope of these specifications, the material of the clamping lever and its shape are freely selectable.

According to the invention, the attachment is arranged within the edge of the liquid container. The bearing surface thereby lies on the container wall or respectively the cover of the container. A groove is usually arranged on the transition from the cover to the edge of the container. If the bearing surface is located in the area of the groove when the attachment is mounted, the attachment—in relation to the cover of the container—in this situation is displaced closer to the cover, wherein the displacement is specified by the depth of the groove. It is obvious that this displacement influences or respectively cancels the effect of the seal, which is the prerequisite for the functioning of the attachment, which is achieved by maintaining the separation distances between the bearing surface or respectively seal, container wall and clamping lever.

According to a preferred embodiment of the invention, counter bearings, which extend from the container, generally from a bottom side of the reservoir, into the bearing plane or beyond the bearing plane, are provided on the attachment within the bearing surface. A single counter bearing can be provided or a plurality of counter bearings. They are arranged within the bearing surface, i.e. where the cover has the required height for the sealed fixing of the attachment, which is adapted to the bearing surface or respectively seal and the clamping lever. The bearing surfaces can be rectangular, cylindrical, conical or shaped like a pyramid or respectively like a truncated cone or truncated pyramid. If there is no seal, the counter bearing ends in the bearing plane. If there is a seal, then the seal should generally be compressed when the attachment is mounted on the liquid container in order to achieve an optimal sealing effect. In this case, the counter bearing preferably extends beyond the bearing plane into a plane, which ensures the desired compression of the seal.

BRIEF DESCRIPTION OF THE DRAWINGS

Details of the invention are explained in greater detail below based on figures. They show in.

DETAILED DESCRIPTION

Figure 1:
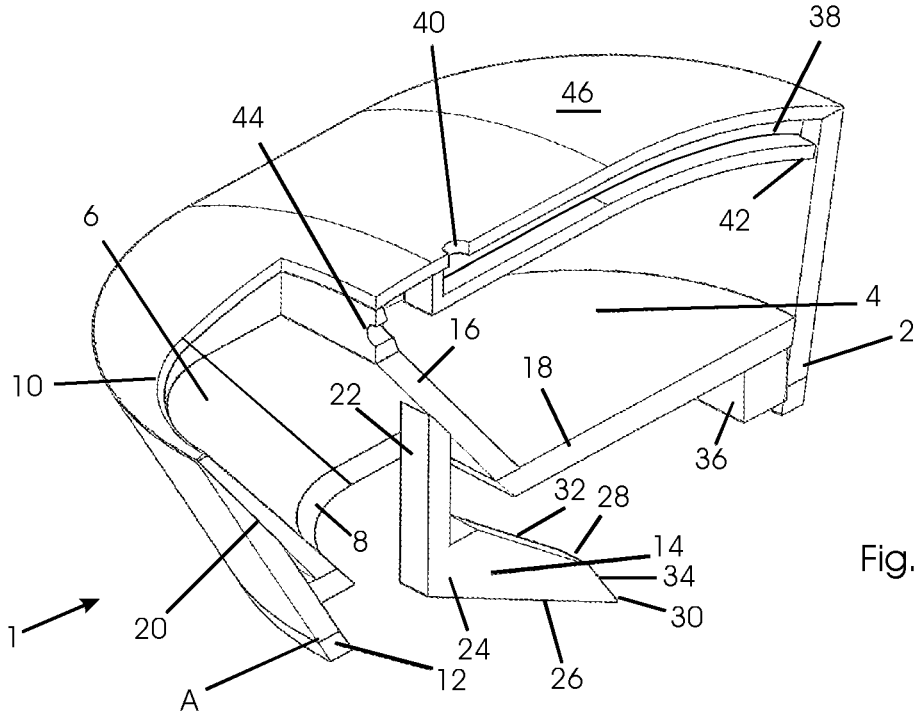
FIG. 1 a cut through the attachment according to the invention (view from the side)
Figure 2:
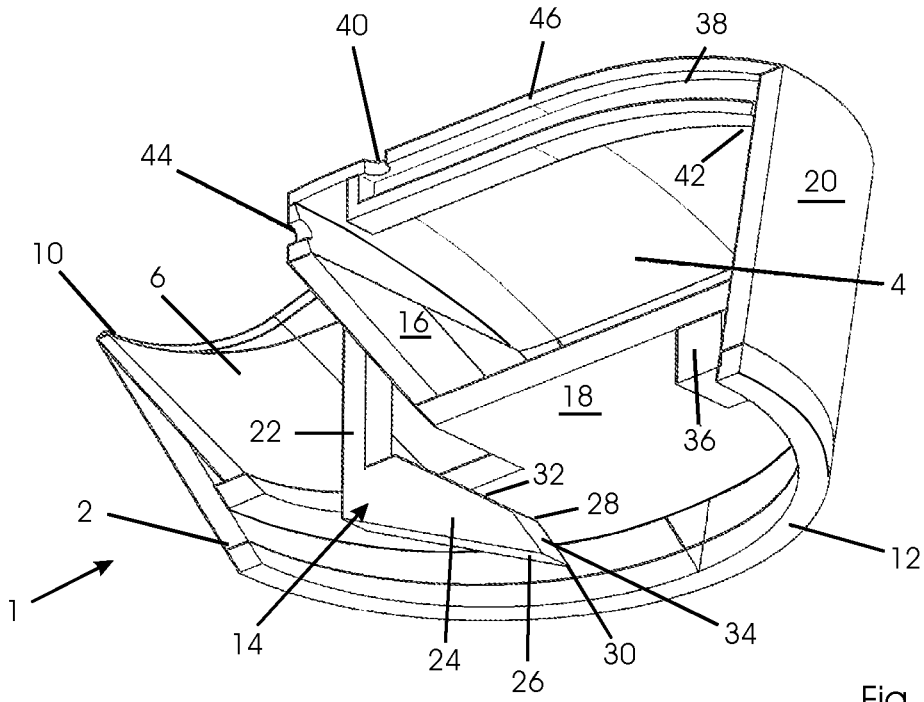
FIG. 2 a cut through the attachment according to the invention (view from below)
Figure 4:
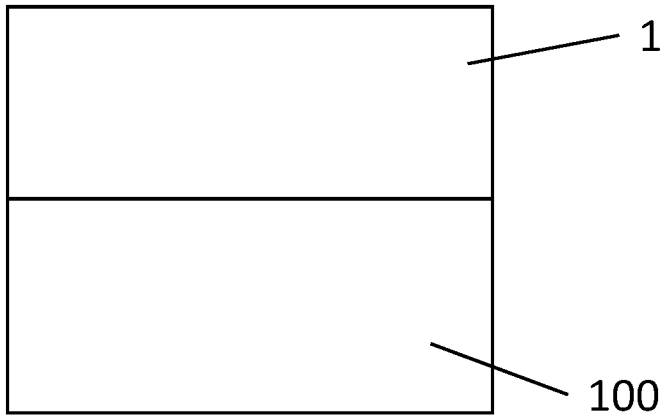
FIG. 4 is a side schematic view of the attachment according to the invention and attached to a container.

FIG. 1 and FIG. 2 show a design of the attachment 1 according to the invention, which is made of plastic in an injection-molding procedure. The attachment is intended for placement on a liquid container (100, FIG. 4) which contains a first liquid. In the present case, it concerns a beverage can. This first liquid is removed through a container outlet (FIG. 4). The container outlet has any shape, e.g. round, oval or square and it frequently has different sizes for different, otherwise similar cans. The container outlet is generally arranged in the cover (FIG. 4) of the can. The container outlet and cover form one plane. The cover forms the can together with the side wall and floor. The side wall and cover are interconnected on the rim by an edge, which surrounds the cover. The edge of the case protrudes, in relation to the cover, over the cover. The cover with the container outlet arranged in it lies counter-sunk within the edge. The container outlet is closed by a closure tab and the opening lever connected with it. The tab can be twisted off from the cover by the lever effect of the bendable opening lever along a breaking edge so that the container outlet is exposed. The tab and the opening lever are undetachably connected with the can through a rivet. When the beverage can is open, the tab is arranged below the cover in the can, the opening lever above the cover. The attachment according to the invention can be mounted on the can opened in this manner and rests on it in a sealing manner.

The attachment has a bearing surface 2, a reservoir 4 for a second liquid and a channel 6. The channel 6 establishes a connection between a container outlet and the outlet 10 of the attachment via an inlet opening 8. The bearing surface 2 defines a bearing plane A. The bearing surface 2 is provided with a seal 12, which is made of elastic plastic. The seal has a cross-section of approx. 2×2 mm and is compressed to approx. 1 mm when the attachment is mounted on the liquid container.

According to the invention, the attachment 1 has a clamping lever 14. The clamping lever 14 extends beyond the bearing plane A. In the use position, i.e. when the attachment is mounted on the liquid container, the clamping lever 14 extends through the container outlet. The clamping lever 14 is fastened in channel 6 on the wall 16 to the reservoir 4. Alternatively, the clamping lever 14 could also be fastened on the bottom side 18 of the reservoir or in channel 6 on the outer wall 20 of the attachment 1. Which embodiment is selected depends on the dimensions of the respective attachment and the desired flow behavior of the first liquid, which is removed from the liquid container when the attachment is fixed.

The clamping lever 14 also has a first section 22, which extends from the attachment in the direction of the bearing plane. The first section 22 of the clamping lever 14 is preferably attached eccentrically in relation to the bearing surface 2. The clamping lever 14 has a second section 24, which extends from the first section 22 to a free end 30. The first section 22 thus connects the attachment with the second section 24. With respect to the bearing plane A, the first section 22 has a greater slope than the second section 24. The clamping lever 14 is thus designed angled or bent. The first section 22 is arranged at an angle of 85° with respect to the bearing plane. It could be arranged at an angle of 60° to 90°. The first section 22 serves to guide the clamping lever 14 into the vicinity of the bearing plane; i.e. the steepest possible arrangement is preferred. Deviations in a range of up to 60° are possible if it enables the construction of the clamping lever 14 or respectively of the attachment.

The second section is arranged at an angle of 40° with respect to the bearing plane. An angle of 20° to 70° is possible, as it is too difficult to insert the clamping lever 14 into the container outlet at a smaller angle. An angle that is too large unnecessarily increases the dimensions of the clamping lever 14 and thus of the attachment 1.

The clamping lever 14 has a bottom side 26 and a top side 28, which can—but do not have to—run parallel. Here, the bottom side 26 and the top side 28 of the first section 22 progress parallel. The top side 28 of the second section 24 progresses, with respect to the bearing plane A, steeper than the bottom side 26 of the second section. The clamping lever 14 thereby has on the transition from the first to the second section a greater material strength and thus a higher stability and also rigidity. The free end 30 of the clamping lever 14 simultaneously has a small cross-section. The top side 28 of the second section 24 has two surfaces with different tilts, the pressing surface 32 with a tilt which is less than the tilt of the guide surface 34 which is greater than the tilt of the pressing surface 32. The pressing surface 32 extends from the transition between the first and second section of the clamping lever 14 up to the guide surface 34. The pressing surface 32 faces the inner wall of the cover of the liquid container in the use position. The guide surface 34 extends from the free end 30 to the pressing surface 32 of the clamping lever. Through the tilt of the guide surface 34 to the free end 30, a wide separation distance is opened between the bottom side 18 of the attachment 1 and the top side 28 of the clamping lever, which facilitates the insertion of the clamping lever 14 into the container outlet.

Figure 3:
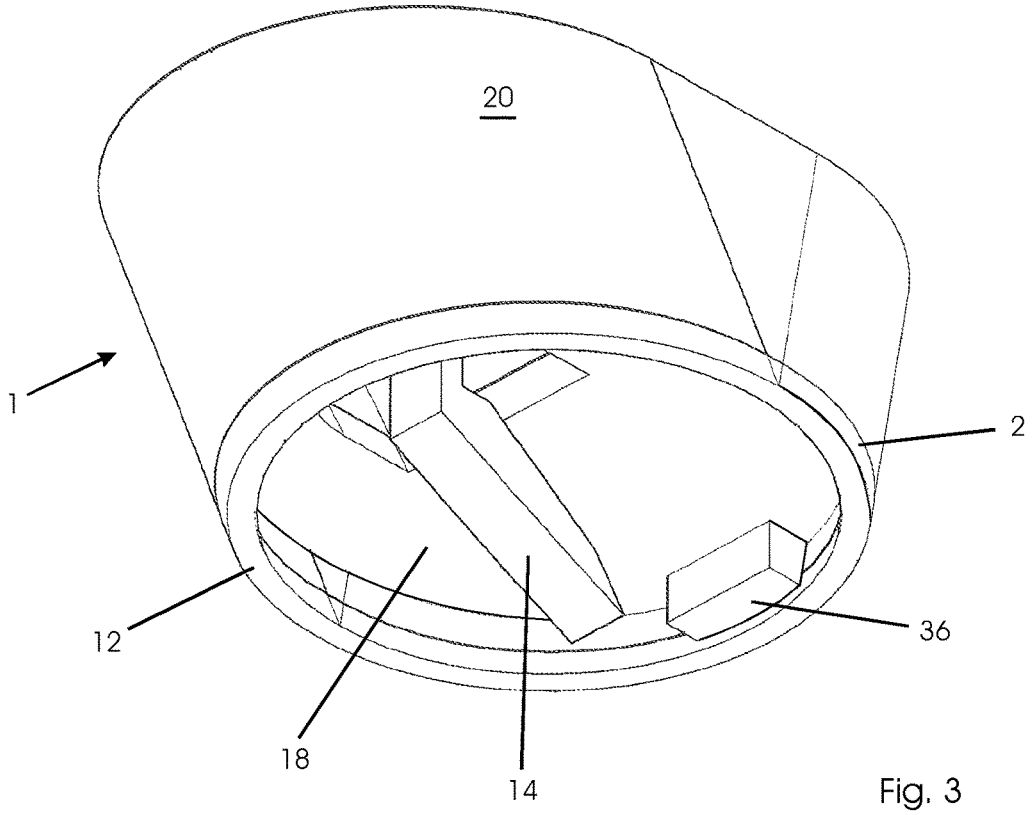
FIG. 3 view of the attachment according to the invention from below.

The tilt of the pressing surface 32 is selected depending on the container wall, here the cover of the beverage can and the bearing surface 2 or respectively of the seal 12 in order to ensures a secure seating of the attachment. It is preferably between 30° and 55° with respect to the bearing plane. The pressing surface 32 is advantageously arranged in the center point of the bearing surface 2. However, in order to prevent the clamping lever 14 from becoming too long and thus the engagement of the clamping lever 14 in the container outlet from becoming too difficult, the pressing surface 32 can be arranged eccentrically, as shown in FIG. 1-3. In this case, it is preferably arranged in a range of up to ⅔ of the radius of the bearing surface, starting from the center point of the bearing surface, particularly preferably in a range of up to ⅓ of the radius of the bearing surface. The distance between the free end 30 of the clamping lever 14 and the bearing surface 2 or respectively the bottom side 18 of the attachment 1 is sufficiently large so that the clamping lever can also be inserted into a narrow container outlet.

In the use position, the clamping lever 14 rests with the pressing surface 32 on the inside of the cover of the beverage can. The clamping lever 14 tensions the cover between the pressing surface 32 and the bottom side 18 of the attachment. According to the exemplary embodiment shown in FIG. 1-3, the clamping lever 14 and the bottom side 18 of the attachment 1 are designed rigidly. The separation distance between the pressing surface 32 and the bottom side 18 of the attachment is nevertheless variable through the tilt of the pressing surface 32. After the clamping lever 14 with the pressing surface 32 engages with the cover of the beverage can, the seal 12, which is applied, in this case: glued, to the bearing surface 2, is compressed and thus bears in a sealing manner against the container wall, here the outside of the cover of the beverage can.

If the bearing surface 2 or respectively the seal 12 of the attachment 1 should be positioned in the use position in a groove between the cover and the protruding edge of the side wall of the beverage can, the seal in the use position, i.e. when the attachment is mounted, may no longer be adequately compressed. In this case, in order to prevent leaks between the attachment and the liquid container, at least one counter bearing 36 is arranged on the attachment 1, preferably on the bottom side 18, according to a particularly advantageous design of the invention. The counter bearing 36 extends up to into the bearing plane, given the case that the bearing surface 2 bears directly against the container wall. The counter bearing 36 extends, if applicable, beyond this if a seal 12 is applied to the bearing surface 2; however, it does not extend beyond the seal 12 but rather only up to into the plane, which is specified by the compressed seal 12 (see FIG. 3). The counter bearing 36 ensures in a simple manner that the attachment 1 rests on the outside of the container wall, generally on the cover of a beverage can. Together with the clamping lever 14, the counter bearing 36 effectuates the sealing placement of the bearing surface 2 on the liquid container even when the bearing surface 2 is arranged above a groove on the edge of the cover of the liquid container.

The counter bearing 36 can be designed as a block, as shown in FIG. 3, which is attached to the edge of the bearing surface 2. The counter bearing 36 can have any shape; it can for example consist of cylinders, truncated cones or truncated pyramids, which are arranged on the attachment 1, normally on the bottom side 18. Several counter bearings 36 can also be provided.

According to a further advantageous embodiment, the attachment according to the invention has a ventilation duct 38, which extends from an air supply opening 40 in the outer wall 20 of the attachment 1 to an exhaust opening 42 in the reservoir 4. Compared to a simple ventilation opening, the ventilation duct 38 offers the advantage that the risk of leakage of liquid is minimized. Moreover, by means of the ventilation duct 38, the arrangement of the air supply opening 40 near the passage 44 is possible, which connects the reservoir 4 with the channel 6. In this manner, according to a preferred design of the invention, the passage 44 and the air supply opening 40 can be jointly sealed by a single closure after the filling of the reservoir with the second liquid during transport, e.g. by a film or a composite made of plastic, metal and/or paper or by a paper. The air supply opening 40 has a diameter of preferably up to 2 mm; the passage 44 can have any shape, e.g. 1 mm high and 4 mm wide or round or oval. The closure is preferably glued on and is removed after the placement of the attachment 1 on the liquid container. In this manner, a reliable ventilation of the reservoir 4 is ensured without which the desired removal of the second liquid from the reservoir 4 would not be possible. The ventilation duct 38, through which the exhaust opening 42 is preferably displaced into an area which is opposed to the passage 44 and the air supply opening 40, prevents that the second liquid escapes through the air supply opening 40 during removal from the reservoir. During removal of the second liquid from the reservoir 4, the exhaust opening 42 preferably lies above the liquid level.

The reservoir 4 is formed by the outer wall 20, the bottom side 18 of the attachment 1, the wall 16 to the channel 6 and by a cover 46 (see FIG. 2). The cover can be designed in a detachable manner. After the filling of the reservoir 4, the cover 46 is preferably connected undetachably, e.g. glued or welded, with the attachment 1 or respectively with the outer wall 20. Alternatively, the reservoir can be filled through the passage 44. The ventilation duct 38 is preferably attached to the cover 46.

The attachment according to the invention can be produced in any manner; injection molding with plastic is particularly preferred. The attachment is preferably produced as one piece, except for the cover 46, which is normally also produced through injection molding and is usually only mounted after the filling of the reservoir 4. Alternatively, the clamping lever 14 can be connected with the attachment 1 later, e.g. through welding or gluing, but also through locking or clamping. The cover and the clamping lever can be made of the same material as the attachment or of another material, e.g. of another plastic, metal or composite material, e.g. a fiber-reinforced plastic. The clamping lever 14 typically protrudes out of the channel 6 under the bottom side 18 of the reservoir 4. Alternatively, it can be attached to the bottom side 18.

After the production of the attachment 1, the reservoir is filled with the second liquid, e.g. a juice or tea concentrate or an alcoholic liquid. The cover 46 is then applied. After the filling of the reservoir and the placement of the cover 46, the passage 44 and the air supply opening 40 are closed. The attachment 1 is thus ready for transport and use.

After the opening of a liquid container, here a beverage can, the clamping lever 14 is inserted through the container outlet until the pressing surface 32 rests against the inner side of the container wall. Depending on the design of the container wall, which surrounds the container outlet, e.g. as a rigid or as an elastic cover, the attachment is tensioned in a sealing manner on a rigid cover between clamping lever 14 and bearing surface 2 or respectively elastic seal 12. Alternatively, an elastic cover curves between clamping lever 14 and bearing surface 2 or respectively elastic seal 12. The clamping lever 14 can be designed rigidly or elastically. The only thing that matters in the respective design of the attachment 1 is that sufficient force is built up between the clamping lever 14 and bearing surface 2 or respectively seal 12, which ensures the sealing placement of bearing surface 2 or seal 12. It is now possible to drink or pour from the liquid container with the attachment 1. For this purpose, the liquid container with the attachment 1 is tilted and the first liquid exits through the container outlet into the space between the liquid container and the attachment and the channel 6, which opens into the outlet 10. While the first liquid flows loss-free in this manner through the channel and exits from the outlet 10, the second liquid flows as a result of the tilt of the attachment through the passage 44 and mixes with the first liquid.

The pressing surface 32 of the clamping lever 14 arranged within the bearing surface 2 builds up pressure on the bearing surface 2 or respectively the seal 12 in beneficial force distribution from an approximately central arrangement. A firm seating of the attachment 1 on the liquid container is thereby ensured. An opening lever located approximately on the top side of the cover, with which the liquid container was opened, is received in the space between the liquid container and the bottom side 18 of the attachment. The opening lever is not disruptive; it builds up, if applicable, additional force, which supports the sealing placement of the attachment on the liquid container.

The above description uses a beverage can as an exemplary embodiment. But it is applicable to all liquid containers, in which the container wall surrounds the container outlet in the plane of the container outlet, as is the case with the cover of the beverage can. Various characteristics of the attachment can be freely combined.

The invention claimed is:

1. In combination, a liquid container (100) and an attachment (1) for the liquid container, wherein the liquid container contains a first liquid and has a container wall having an inner surface and defining a container outlet, and wherein the attachment (1) comprises a bearing surface (2), which defines a bearing plane (A), for bearing in a sealing manner against the liquid container, a reservoir (4) for a second liquid, a channel (6), which connects the container outlet to an outlet (10) of the attachment (1), a passage (44), which connects the reservoir (4) to the channel (6), and the combination further comprising a clamping lever (14) which, in a use position, extends from the attachment through the bearing plane (A) and the container outlet and which has a pressing surface (32) facing upwardly to apply a bearing force to the liquid container in the use position wherein the clamping lever (14) has a first section (22), which extends at a first end from the attachment and to a second end, and has a second section (24) extending from the second end of the first section, wherein, with respect to the bearing plane (A), the first section (22) has a different slope than the second section (24), and wherein the pressing surface (32) is defined on the second section (24), wherein the second section (24) of the clamping lever (14) terminates in a free end (30), wherein the second section (24) of the clamping lever (14) has a guide surface (34) with a first slope, which extends from the free end (30) in a direction of the first section (22), wherein the pressing surface (32) connects to the guide surface (34), the pressing surface (32) extending from a transition between the first section (22) and second section (24) in a direction of the free end (30), wherein the pressing surface (32) has a second slope, which differs from the first slope.

2. The apparatus according to claim 1, wherein the clamping lever (14) is designed rigidly.

3. The apparatus according to claim 1, wherein the clamping lever (14) is designed as a lever or bracket.

4. The apparatus according to claim 1, wherein the first section of the clamping lever (14), with respect to the bearing surface (2), is attached eccentrically to the attachment.

5. The apparatus according to claim 1, wherein the clamping lever (14) has the pressing surface (32), which, starting from a center point of the bearing surface (2) is arranged at a separation distance of up to ⅔ of a radius of the bearing surface (2).

6. The apparatus according to claim 1, wherein the bearing surface (2) is provided with a seal (12).

7. The apparatus according to claim 1, wherein the reservoir (4) is provided with a ventilation duct (38).

8. The apparatus according to claim 7, wherein the ventilation duct (38) has an exhaust opening (42) which opens into an area of the reservoir (4) opposite the passage (44) and an air supply opening (40) which opens on a same side of the attachment as the passage (44) from the reservoir (4) into the channel (6).

9. The apparatus according to claim 1, wherein the clamping lever (14) is designed elastically.

* * * * *